US010954615B2

(12) United States Patent
Mason

(10) Patent No.: US 10,954,615 B2
(45) Date of Patent: Mar. 23, 2021

(54) MIGRATION RESISTANT BATTING WITH STRETCH AND METHODS OF MAKING AND ARTICLES COMPRISING THE SAME

(71) Applicant: PRIMALOFT, INC., Latham, NY (US)

(72) Inventor: Vanessa Mason, Rexford, NY (US)

(73) Assignee: PRIMALOFT, INC., Latham, NY (US)

( * ) Notice: Subject to any disclaimer, the term of this patent is extended or adjusted under 35 U.S.C. 154(b) by 123 days.

(21) Appl. No.: 15/542,678

(22) PCT Filed: Jan. 20, 2016

(86) PCT No.: PCT/US2016/014111
§ 371 (c)(1),
(2) Date: Jul. 11, 2017

(87) PCT Pub. No.: WO2016/118614
PCT Pub. Date: Jul. 28, 2016

(65) Prior Publication Data

US 2017/0370037 A1 Dec. 28, 2017

Related U.S. Application Data

(60) Provisional application No. 62/106,014, filed on Jan. 21, 2015.

(51) Int. Cl.
*D04H 5/00* (2012.01)
*D04H 1/4382* (2012.01)
(Continued)

(52) U.S. Cl.
CPC ..... *D04H 1/4382* (2013.01); *D02G 1/00* (2013.01); *D02J 13/00* (2013.01); *D04H 1/02* (2013.01);
(Continued)

(58) Field of Classification Search
CPC ..... D04H 1/4382; D04H 5/00
See application file for complete search history.

(56) References Cited

U.S. PATENT DOCUMENTS 3,402,070 A 9/1968 Brodmann
3,454,422 A 7/1969 Mead et al.
(Continued)

FOREIGN PATENT DOCUMENTS

CN 102260959 A 11/2011
CN 103306050 A 9/2013
(Continued)

OTHER PUBLICATIONS

Definition of "melt-blowing" The Complete Textile Glossary, Celanese Acetate, 2001. (Year: 2001).*
(Continued)

*Primary Examiner* — Andrew T Piziali
(74) *Attorney, Agent, or Firm* — Heslin Rothenberg Farley & Mesiti P.C.

(57) ABSTRACT

The invention provides migration resistant batting that includes a nonwoven web comprising a first surface parallel to a second surface, and a fiber mixture that includes: 35 to 65 wt % synthetic polymeric fibers having a denier of less than or equal to 1.0, wherein 50 to 100 wt % of said synthetic polymeric fibers are siliconized fibers; 10 to 30 wt % spiral-crimped synthetic polymeric fibers having a length of greater than or equal to 60 mm, wherein 50 to 100 wt % of said spiral-crimped synthetic polymeric fibers are siliconized fibers; 20 to 50 wt % elastomeric fibers having a denier between 2.0 and 7.0; and 5 to 25 wt % synthetic binder fibers having a denier of 1.5 to 4.0, said binder fibers have a bonding temperature lower than the softening temperature of the synthetic polymeric fibers, wherein said first and second surfaces comprise a cross-linked resin. Also
(Continued)

provided are articles comprising the batting and methods of making the batting.

28 Claims, 6 Drawing Sheets

(51) Int. Cl.

| | |
|---|---|
| ***D02G 1/00*** | (2006.01) |
| ***D04H 1/4391*** | (2012.01) |
| ***D04H 1/541*** | (2012.01) |
| ***D04H 1/64*** | (2012.01) |
| ***D04H 1/02*** | (2006.01) |
| ***D02J 13/00*** | (2006.01) |
| ***D04H 1/435*** | (2012.01) |
| *A41D 31/00* | (2019.01) |
| *A47C 17/86* | (2006.01) |

(52) U.S. Cl.
CPC ..... *D04H 1/435* (2013.01); *D04H 1/4391* (2013.01); *D04H 1/541* (2013.01); *D04H 1/64* (2013.01); *A41D 31/00* (2013.01); *A47C 17/86* (2013.01)

(56) References Cited

U.S. PATENT DOCUMENTS

| | | | | |
|---|---|---|---|---|
| 4,118,531 | A * | 10/1978 | Hauser | B01D 39/1623 156/62.2 |
| 4,304,817 | A | 12/1981 | Frankosky | |
| 4,588,635 | A | 5/1986 | Donovan | |
| 5,344,707 | A | 9/1994 | Snyder | |
| 5,527,600 | A | 6/1996 | Frankosky et al. | |
| 5,798,166 | A | 8/1998 | Gross | |
| 5,873,964 | A | 2/1999 | Kwok | |
| 6,329,051 | B1 | 12/2001 | Groh et al. | |
| 6,329,052 | B1 | 12/2001 | Groh et al. | |
| 6,492,020 | B1 | 12/2002 | Ahn et al. | |
| 6,589,652 | B2 | 7/2003 | Groh et al. | |
| 7,261,936 | B2 | 8/2007 | Davis et al. | |
| 7,790,639 | B2 | 9/2010 | Davenport et al. | |
| 9,185,941 | B2 | 11/2015 | Mason et al. | |
| 9,340,907 | B2 | 5/2016 | Patterson | |
| 2004/0116024 | A1 | 6/2004 | Zafiroglu et al. | |
| 2006/0035555 | A1 * | 2/2006 | Narayanan | B32B 5/022 442/387 |
| 2006/0068176 | A1 | 3/2006 | Zafiroglu et al. | |
| 2008/0070465 | A1 | 3/2008 | Wiles | |
| 2014/0206796 | A1 | 7/2014 | Primaloft Inc | |

FOREIGN PATENT DOCUMENTS

| | | | |
|---|---|---|---|
| CN | 104250880 | A | 12/2014 |
| JP | 2006-187710 | A | 7/2006 |
| JP | 2008303480 | A | 12/2008 |
| WO | 00/06379 | A1 | 2/2000 |
| WO | 03/040452 | A1 | 5/2003 |
| WO | 2016/100616 | A1 | 6/2016 |

OTHER PUBLICATIONS

Extended European Search Report of the International Searching Authority for PCT/US2016/014111, dated Jun. 14, 2018.

International Search Report and Written Opinion of the International Searching Authority for PCT/US2016/014111, dated Apr. 11, 2016.

* cited by examiner

MIGRATION RESISTANT BATTING WITH STRETCH AND METHODS OF MAKING AND ARTICLES COMPRISING THE SAME

CROSS REFERENCE TO RELATED APPLICATIONS

This application is a U.S. national phase entry under Section 371 of International Application No. PCT/US2016/014111, filed on Jan. 20, 2016, which published as WO2016/118614 A1 on Jul. 28, 2016, which claims priority to U.S. provisional application No. 62/106,014, filed on Jan. 21, 2015, The entire contents of each of the prior applications are hereby incorporated herein by reference.

FIELD OF THE INVENTION

The present invention generally relates to migration resistant batting, to articles comprising the batting, and to methods of making the batting.

BACKGROUND OF THE INVENTION

Microfibers are those fibers having a denier of less than or equal to 1.0 denier ("denier" being a measure of the weight in grams per 9,000 meters length of fiber). Synthetic microfiber insulations have been available in the commercial marketplace for decades now. Siliconized hydrophobic microfiber insulation is also known. Such fiber is described, for example, in U.S. Pat. No. 4,588,635, and is available in the performance outdoor marketplace under the brand name PrimaLoft®.

The outdoor industry has utilized hydrophobic microfiber insulations for use in cold weather apparel, sleeping bags, and gloves for many years. However, the disadvantage to using hydrophobic microfiber insulation has always been that this type of insulation is highly prone to display severe fiber migration through fabric surfaces, even when combined with low air permeability downproof fabrics and protected by nonwoven scrim materials.

Scrim is an interlining that is often used as a protective layer between insulation and a shell or liner fabric of an article. Fiber migration is the penetration of fiber through the fabric surface such that fiber is present on the face side of the article, which is typically the outside of the article that is exposed to the external environment.

Downproof fabrics are typically defined as fabrics that are tightly woven with thread counts greater than 250 and have an air permeability rating according to ASTM D737 less than 1 cubic feet per minute (cfm). Sometimes fabrics have coatings applied to them or are calendared to seal their surface as a means to achieve downproofness. These treatments further reduce the air permeability of the fabric, which has a direct effect on the overall comfort of an article. The lower the air permeability of the fabric, the less breathable and comfortable it is. The higher the air permeability of the fabric, the more breathable and comfortable it is.

Migration resistant insulation for use in outdoor articles is also known in the art. These insulations are typically comprised predominantly of higher denier fibers in excess of 1.0 denier and do not contain hydrophobic finishes. It is easy to create migration resistant surfaces on these types of commonly produced generic insulations using commercially available chemical resins as bonding agents on the surface of the insulation. However, there are a variety of disadvantages associated with this type of treatment, including the fact that the treatments make the insulation stiff and crunchy to the hand feel, reduce stretch, and are not comfortable to wear. Further, most commercially available chemical resins used to create migration resistant surfaces adsorb water quickly, which represents a considerable disadvantage for outdoor articles that require both performance and comfort.

Thus, a need exists for improved migration resistant batting that is comfortable and conducive to use in, among other things, applications involving wet and/or high performance conditions, such as outdoor active wear.

While certain aspects of conventional technologies have been discussed to facilitate disclosure of the invention, Applicant in no way disclaims these technical aspects, and it is contemplated that the claimed invention may encompass one or more of the conventional technical aspects discussed herein.

In this specification, where a document, act or item of knowledge is referred to or discussed, this reference or discussion is not an admission that the document, act or item of knowledge or any combination thereof was, at the priority date, publicly available, known to the public, part of common general knowledge, or otherwise constitutes prior art under the applicable statutory provisions; or is known to be relevant to an attempt to solve any problem with which this specification is concerned.

SUMMARY OF THE INVENTION

Briefly, the present invention satisfies the need for improved migration resistant batting. The present invention may address one or more of the problems and deficiencies of the art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In a first aspect, the invention provides batting comprising a nonwoven web having a first surface parallel to a second surface, wherein said nonwoven web comprises a fiber mixture having:

- 35 to 65 wt % synthetic polymeric fibers (referred to as a first population) having a denier of less than or equal to 1.0, wherein 50 to 100 wt % of said synthetic polymeric fibers are siliconized fibers;
- 10 to 30 wt % spiral-crimped synthetic polymeric fibers (referred to as a second population) having a length of greater than or equal to 60 mm, wherein 50 to 100 wt % of said spiral-crimped synthetic polymeric fibers are siliconized fibers;
- 20 to 50 wt % elastomeric fibers having a denier between 2.0 and 7.0; and
- 5 to 25 wt % synthetic binder fibers having a denier of 1.5 to 4.0, said binder fibers have a bonding temperature lower than the softening temperature of the synthetic polymeric fibers, and wherein said first and second surfaces comprise a cross-linked resin.

In a second aspect, the invention provides an article comprising the inventive batting.

In a third aspect, the invention provides a method of making the inventive batting, said method comprising:

preparing a fiber mixture by mixing:

- 35 to 65 wt % of a first population of synthetic polymeric fibers having a denier of less than or equal to 1.0, wherein 50 to 100 wt % of said synthetic polymeric fibers are siliconized fibers;

10 to 30 wt % of a second population of spiral-crimped synthetic polymeric fibers having a length of greater than or equal to 60 mm, wherein 50 to 100 wt % of said spiral-crimped synthetic polymeric fibers are siliconized fibers;

20 to 50 wt % elastomeric fibers having a denier between 2.0 and 7.0; and 5 to 25 wt % synthetic binder fibers having a denier of 1.5 to 4.0, said binder fibers have a bonding temperature lower than the softening temperature of the synthetic polymeric fibers;

forming a nonwoven web from the fiber mixture, said nonwoven web comprising a first surface parallel to a second surface;

heating the non-woven web to or in excess of the bonding temperature of the binder fibers, thereby forming a bonded nonwoven web;

applying a cross-linker solution comprising a cross-linker compound to the first and second surfaces of the bonded nonwoven web; and heating the bonded nonwoven web to a temperature in excess of the glass transition temperature of the cross-linker compound, thereby forming the batting.

Certain embodiments of the presently-disclosed migration resistant batting, articles comprising the batting, and methods for forming the batting have several features, no single one of which is solely responsible for their desirable attributes. Without limiting the scope of the batting, articles and methods as defined by the claims that follow, their more prominent features will now be discussed briefly. After considering this discussion, and particularly after reading the section of this specification entitled "Detailed Description of the Invention," one will understand how the features of the various embodiments disclosed herein provide a number of advantages over the current state of the art.

These and other features and advantages of this invention will become apparent from the following detailed description of the various aspects of the invention taken in conjunction with the appended claims and the accompanying drawings.

BRIEF DESCRIPTION OF THE DRAWINGS

The present invention will hereinafter be described in conjunction with the following drawing figures, wherein like numerals denote like elements, and.

DETAILED DESCRIPTION OF THE INVENTION

Aspects of the present invention and certain features, advantages, and details thereof, are explained more fully below with reference to the non-limiting embodiments illustrated in the accompanying drawings. Descriptions of well-known materials, fabrication tools, processing techniques, etc., are omitted so as to not unnecessarily obscure the invention in detail. It should be understood, however, that the detailed description and the specific example(s), while indicating embodiments of the invention, are given by way of illustration only, and are not by way of limitation. Various substitutions, modifications, additions and/or arrangements within the spirit and/or scope of the underlying inventive concepts will be apparent to those skilled in the art from this disclosure.

In a first aspect, the invention provides batting comprising a nonwoven web having a first surface parallel to a second surface, wherein said nonwoven web comprises a fiber mixture having:

35 to 65 wt % of a first population of synthetic polymeric fibers having a denier of less than or equal to 1.0, wherein 50 to 100 wt % of said synthetic polymeric fibers are siliconized fibers;

10 to 30 wt % of a second population of spiral-crimped synthetic polymeric fibers having a length of greater than or equal to 60 mm, wherein 50 to 100 wt % of said spiral-crimped synthetic polymeric fibers are siliconized fibers;

20 to 50 wt % elastomeric fibers having a denier between 2.0 and 7.0; and 5 to 25 wt % synthetic binder fibers having a denier of 1.5 to 4.0, said binder fibers have a bonding temperature lower than the softening temperature of the synthetic polymeric fibers, and wherein said first and second surfaces comprise a cross-linked resin.

In some embodiments, the fibers in the fiber mixture are homogenously mixed, meaning, the fiber mixture has a substantially uniform (i.e., 90-100% uniform) composition.

Figure 1:
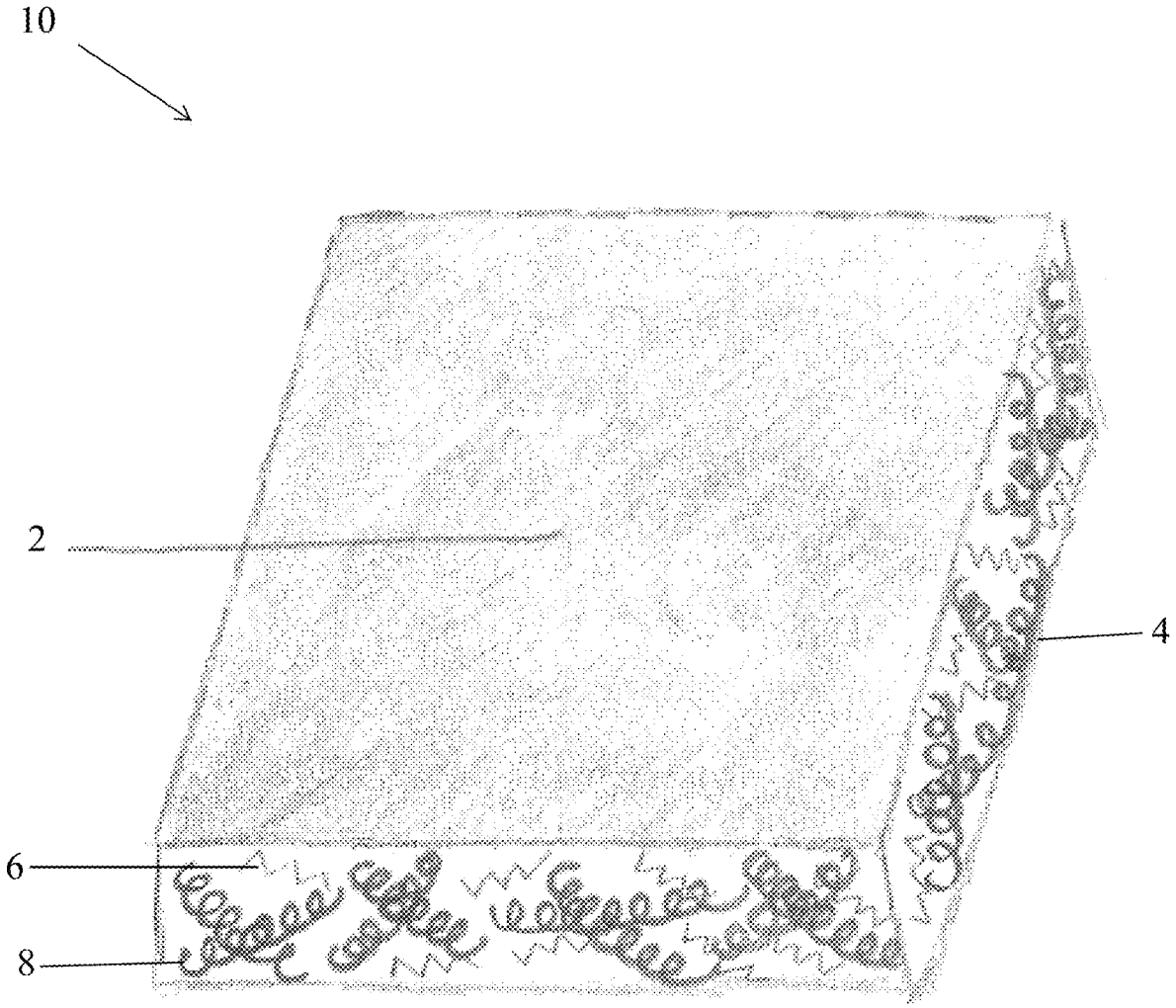
FIG. 1 illustrates a top-view of an embodiment of the inventive batting.

FIG. 1 illustrates a top-view of an embodiment of the inventive batting. The depicted batting 10 comprises first surface 2 and second surface 4 (which is parallel to first surface 2). In some embodiments, when batting 10 is contained within in an article (e.g., as insulation), first surface 2 will face toward an outer portion (e.g., fabric or other material or liner) of the article, e.g., a jacket, and second surface 4 will face toward an inner portion (e.g., fabric or other material or liner) of the article. For example, in jackets, articles of clothing, etc., the outer portion is the environmentally-facing portion, whereas the inner portion is the wearer-facing portion. In other embodiments, first surface 2 faces toward an inner portion of an article and second surface 4 faces toward an outer portion of an article.

The fiber mixture of batting 10 comprises 35 to 65 wt % synthetic polymeric fibers 6 (a first population of synthetic polymeric fibers) having a denier of less than or equal to 1.0, wherein 50 to 100 wt % of said synthetic polymeric fibers are siliconized fibers.

Synthetic polymeric fibers are well known in the art. Non-limiting examples of synthetic fibers include nylon, polyester, acrylic, polyolefin, polylactide, acetate, aramid, lyocell, spandex, viscose, modal, and combinations thereof. In a particular embodiment, the polymer fiber comprises polyester.

In some embodiments, the synthetic polymeric fibers comprise polyester, wherein said polyester is selected from poly(ethylene terephthalate), poly(hexahydro-p-xylylene terephthalate), poly(butylene terephthalate), poly-1,4-cyclohexelyne dimethylene (PCDT) and terephthalate copolyesters in which at least 85 mole percent of the ester units are ethylene terephthalate or hexahydro-p-xylylene terephthalate units. In a particular embodiment, the polyester is polyethylene terephthalate.

The weight percent of the synthetic polymeric fibers in the fiber mixture is 35 to 65 wt % including any and all ranges and subranges therein (e.g., 40 to 55 wt %). For example, in some embodiments, the fiber mixture comprises 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, or 65 wt % synthetic polymeric fibers.

Denier is a unit of measure defined as the weight in grams of 9000 meters of a fiber or yarn. It is a common way to specify the weight (or size) of the fiber or yarn. For example, polyester fibers that are 1.0 denier typically have a diameter of approximately 10 micrometers. Micro-denier fibers are those having a denier of 1.0 or less, while macro-denier fibers have a denier greater than 1.0.

The synthetic polymeric fibers are microfibers, that is, they have a denier of less than or equal to 1.0 denier. In some embodiments, the denier is 0.4 to 1.0, including any and all ranges and subranges therein. For example, in some embodiments, the denier is 0.4, 0.5, 0.6, 0.7, 0.8, 0.9, or 1.0.

In some embodiments, the synthetic polymeric fibers have a length of less than 60 mm. For example, in some embodiments, the synthetic polymeric fibers have a length of 18 mm to 59 mm, including any and all ranges and subranges therein. For example, in some embodiments, the length is 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, or 59 mm, including all ranges/subranges therein (e.g., 18 to 51 mm, 40 to 59 mm, etc.).

As indicated above, 50 to 100% of the synthetic polymeric fibers, including any and all ranges and subranges therein (e.g., 75 to 100%) are siliconized. Siliconization techniques are well known in the art. The term "siliconized" means that the fiber is coated with a silicon-comprising composition (e.g., a silicone). Siliconization techniques are well known in the art, and are described, e.g., in U.S. Pat. No. 3,454,422. The silicon-comprising composition may be applied using any method known in the art, e.g., spraying, mixing, dipping, padding, etc. The silicon-comprising (e.g., silicone) composition, which may include an organosiloxane or polysiloxane, bonds to an exterior portion of the fiber. In some embodiments, the silicone coating is a polysiloxane such as a methylhydrogenpolysiloxane, modified methylhydrogenpolysiloxane, polydimethylsiloxane, or amino modified dimethylpolysiloxane. As is known in the art, the silicon-comprising composition may be applied directly to the fiber, or may be diluted with a solvent as a solution or emulsion, e.g. an aqueous emulsion of a polysiloxane, prior to application. Following treatment, the coating may be dried and/or cured. As is known in the art, a catalyst may be used to accelerate the curing of the silicon-comprising composition (e.g., polysiloxane containing Si—H bonds) and, for convenience, may be added to a silicon-comprising composition emulsion, with the resultant combination being used to treat the synthetic fiber. Suitable catalysts include iron, cobalt, manganese, lead, zinc, and tin salts of carboxylic acids such as acetates, octanoates, naphthenates and oleates. In some embodiments, following siliconization, the fiber may be dried to remove residual solvent and then optionally heated to between 65° and 200° C. to cure.

In some embodiments, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, or 100% of the synthetic polymeric fibers are siliconized.

The synthetic polymeric fibers may be crimped. Various crimps, including spiral and standard crimp, are known in the art. In some embodiments, the synthetic polymeric fibers have a non-spiral crimp. In the batting 10, the synthetic polymeric fibers have a standard, planar crimp.

The fiber mixture of batting 10 also comprises 10 to 30 wt spiral-crimped synthetic polymeric fibers 8 (a second population of synthetic polymeric fibers, often distinguished herein from the first population by being referred to as the "spiral-crimped synthetic polymeric fibers," although in embodiment, the first population may also comprise spiral-crimped fibers) having a length of greater than or equal to 60 mm, wherein 50 to 100 wt % of said spiral-crimped synthetic polymeric fibers are siliconized fibers. The spiral-crimped synthetic polymeric fibers 8 are synthetic fibers as discussed above in connection with the first population of synthetic polymeric fibers (although the first and second populations may comprise the same or different synthetic fibers). A spiral-crimped fiber is a fiber having a spiral (i.e., helical) configuration. The weight percent of the spiral-crimped synthetic polymeric fibers in the fiber mixture is 10 to 30 wt % including any and all ranges and subranges therein (e.g., 15 to 25 wt %). For example, in some embodiments, the fiber mixture comprises 10, 11, 12, 13, 14, 15, 16, 17, 18, 19, 20, 21, 22, 23, 24, 25, 26, 27, 28, 29, or 30 wt % spiral-crimped synthetic polymeric fibers.

In some embodiments, the spiral-crimped synthetic polymeric fibers have a length of 60 to 80 mm, including any and all ranges and subranges therein (e.g., 60 to 75 mm). For example, in some embodiments, the length is 60, 61, 62, 63, 64, 65, 66, 67, 68, 69, 70, 71, 72, 73, 74, 75, 76, 77, 78, 79, or 80 mm (e.g., 64 mm). Fiber lengths, throughout this application, are pre-crimp measurements (i.e., the length measurement of a fiber before it is crimped).

In some embodiments, the denier of the spiral-crimped synthetic polymeric fibers is from 2.0 to 10.0 denier, including any and all ranges and subranges therein. For example, in some embodiments, the denier of the spiral-crimped synthetic polymeric fibers is 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, 8.0, 8.1, 8.2, 8.3, 8.4, 8.5, 8.6, 8.7, 8.8, 8.9, 9.0, 9.1, 9.2, 9.3, 9.4, 9.5, 9.6, 9.7, 9.8, 9.9, or 10.0 denier.

As indicated above, 50 to 100% of the spiral-crimped synthetic polymeric fibers, including any and all ranges and subranges therein (e.g., 75 to 100%) are siliconized. For example, in some embodiments, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, or 100% of the spiral-crimped synthetic polymeric fibers are siliconized.

The fiber mixture also comprises 20 to 50 wt % elastomeric fibers (not pictured in FIG. 1) having a denier between 2.0 and 7.0. Elastomeric fibers are those fibers that possess extremely high elongations (e.g., 400%-8001) at break and that recover fully and rapidly from high elongations up to their breaking point. Elastomeric fibers include crosslinked natural and synthetic rubbers, spandex fibers (segmented polyurethanes), anidex fibers (crosslinked polyacrylates) and side-by-side biconstituent fiber of nylon and spandex (Monvelle). Particular embodiments of elastomeric fibers are commercially available from Toray Chemical under the trade name E-Plex.

The fiber mixture comprises 20 to 50 wt % elastomeric fibers, including any and all ranges and subranges therein (e.g., 20 to 35 wt %). In some embodiments, the fiber mixture comprises 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50 wt % elastomeric fibers. The elastomeric fibers have a denier of greater than 2.0 and less than 7.0, including any and all ranges and subranges therebetween. For example, in some embodiments, the elastomeric fibers have a denier of 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, or 6.9 denier.

In some embodiments, the elastomeric fibers have a length of 40 to 80 mm, including any and all ranges and subranges therein (e.g., 50 to 71 mm). For example, in some embodiments, the elastomeric fibers have a length of 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, or 80 mm.

The fiber mixture also comprises 5 to 25 wt % synthetic binder fibers having a denier of 1.5 to 4.0, said binder fibers have a bonding temperature lower than the softening temperature of the synthetic polymeric fibers. The fiber mixture includes 5 to 25 wt % synthetic binder fibers, including any and all ranges and subranges therein (e.g., 5 to 15 wt %). For example, in some embodiments, the fiber mixture comprises 5, 6, 7, 8, 9, 10, 11, 12, 13, 14, 15, 16, 17, 18, 19, 20, 21, 22, 23, 24, or 25 wt % synthetic binder fibers. The binder fibers have a denier of 1.5 to 4.0, including any and all ranges and subranges therein. For example, in some embodiments, the binder fibers have a denier of 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, or 4.0.

In some embodiments, the binder fibers have a length of 20 mm to 71 mm, including any and all ranges and subranges therein (e.g., 40 to 60 mm). For example, in some embodiments, the length is 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, or 71 mm.

As indicated above, the binder fibers have a bonding temperature lower than the softening temperature of the synthetic polymeric fibers. In some embodiments, the first and second populations of synthetic polymeric fibers comprise fibers made from different polymer materials, and thus the first and second populations have different softening temperatures. In these embodiments, the binder fibers have a bonding temperature lower than the softening temperature of both the first and second populations. In some embodiments, the binder fibers have a bonding temperature of less than or equal to 200° C. In some embodiments, the binder fibers have a bonding temperature of 50 to 200° C., including any and all ranges and subranges therein. In some embodiments, the binder fibers have a bonding temperature of 80° C. to 150° C. In some embodiments, the binder fibers have a bonding temperature of 100° C. to 125° C.

In some embodiments, the binder fibers comprise low-melt polyester fibers.

In some embodiments, the binder fibers are bicomponent fibers comprising a sheath and a core, wherein the sheath comprises a material having a lower melting point than the core.

In some embodiments, any of the fibers constituting the fiber mixture may be slickened with a non-silicone slickening agent, e.g., segmented copolymers of polyalkyleneoxide and other polymers, such as polyester, or polyethylene or polyalkylene polymers as is mentioned in U.S. Pat. No. 6,492,020 B1.

The inventive batting, in some embodiments, has been heat treated so as melt all or a portion of the binder fibers, thereby forming a bonded web-type batting. Persons having ordinary skill in the art will understand that, in such embodiments, although "binder fibers" are recited in the fiber mixture of the batting, said fibers may be wholly or partially melted fibers, as opposed to binder fibers in their original, pre-heat treatment form.

In some embodiments, the batting includes a fiber mixture that comprises:

- 40 to 55 wt % of the synthetic polymeric fibers, said fibers having a non-spiral crimp;
- 15 to 25 wt % of the spiral-crimped synthetic polymeric fibers;
- 20 to 35 wt % of the elastomeric fibers; and
- 5 to 15 wt % of the synthetic binder fibers.

In some embodiments, the synthetic polymeric fibers and the spiral-crimped synthetic polymeric fibers are polyester fibers.

As indicated above, the first surface and the second surface comprise a cross-linked resin. The resin is a cross-linked (e.g., via heat treatment) version of the cross-linker solution. In some embodiments, the cross-linked resin comprises a cross-linker that is a cross-linked acrylate (co) polymer. In some embodiments, the cross-linker solution and/or the cross-linker compound display softness and hydrophobicity. In some embodiments, the cross-linker compound has a glass transition temperature (Tg) of less than 0° C.

In some embodiments, the batting has a thickness of 5 to 25 mm (e.g., 5, 6, 7, 8, 9, 10, 11, 12, 13, 14, 15, 16, 17, 18, 19, 20, 21, 22, 23, 24, or 25 mm), including any and all ranges and subranges therein (e.g., 10 to 20 mm).

In some embodiments, the batting has a density of 5 to 7.5 $kg/m^3$, including any and all ranges and subranges therein. For example, in some embodiments, the batting has a density of 5.0, 5.5, 6.0, 6.5, 7.0, or 7.5 $kg/m^3$.

In some embodiments, the batting has a thermal performance rating of at least 0.75 $clo/oz/yd^2$ when tested according to ISO 11092. In some embodiments, the batting has a thermal performance rating of 0.75 $clo/oz/yd^2$ to 1.25 $clo/oz/yd^2$ (e.g., 0.75, 0.76, 0.77, 0.78, 0.79, 0.80, 0.81, 0.82, 0.83, 0.84, 0.85, 0.86, 0.87, 0.88, 0.89, 0.90, 0.91, 0.92, 0.93, 0.94, 0.95, 0.96, 0.97, 0.98, 0.99, 1.0, 1.01, 1.02, 1.03, 1.04, 1.05, 1.06, 1.07, 1.08, 1.09, 1.10, 1.11, 1.12, 1.13, 1.14, 1.15, 1.16, 1.17, 1.18, 1.19, 1.20, 1.21, 1.22, 1.23, 1.24, or 1.25 $clo/oz/yd^2$), including any and all ranges and subranges therein (e.g., 0.75 to 1.0 $clo/oz/yd^2$).

In some embodiments, the batting has a water uptake of less than or equal to 30 wt %. As referred to herein, "water uptake" is determined according to the Hohenstein method for wet thermal performance. The Hohenstein method entails saturating an insulation sample for two minutes in room temperature distilled water and then centrifuging it for 23 seconds under a speed of 1500 revolutions per minute. This process is repeated twice before weighing the wetted sample and comparing its wetted weight to its initial dry weight for determination of the water uptake as a weighted percentage. In some embodiments, the batting has a water uptake of 10 to 30 wt %, including any and all ranges and subranges therein. For example, in some embodiments, the batting has a water uptake of 10, 11, 12, 13, 14, 15, 16, 17, 18, 19, 20, 21, 22, 23, 24, 25, 26, 27, 28, 29, or 30 wt %.

In some embodiments, the batting has multidirectional stretch of 5 to 30%, including any ranges and subranges therein, in one or more of the machine (MD), cross (CD), and diagonal directions, under a load of 0.65 lbs, when tested according to ASTM D3107. For example, in some embodiments, the batting has a MD, CD, and/or diagonal direction stretch of 5, 6, 7, 8, 9, 10, 11, 12, 13, 14, 15, 16, 17, 18, 19, 20, 21, 22, 23, 24, 25, 26, 27, 28, 29, or 30%.

Figure 2:
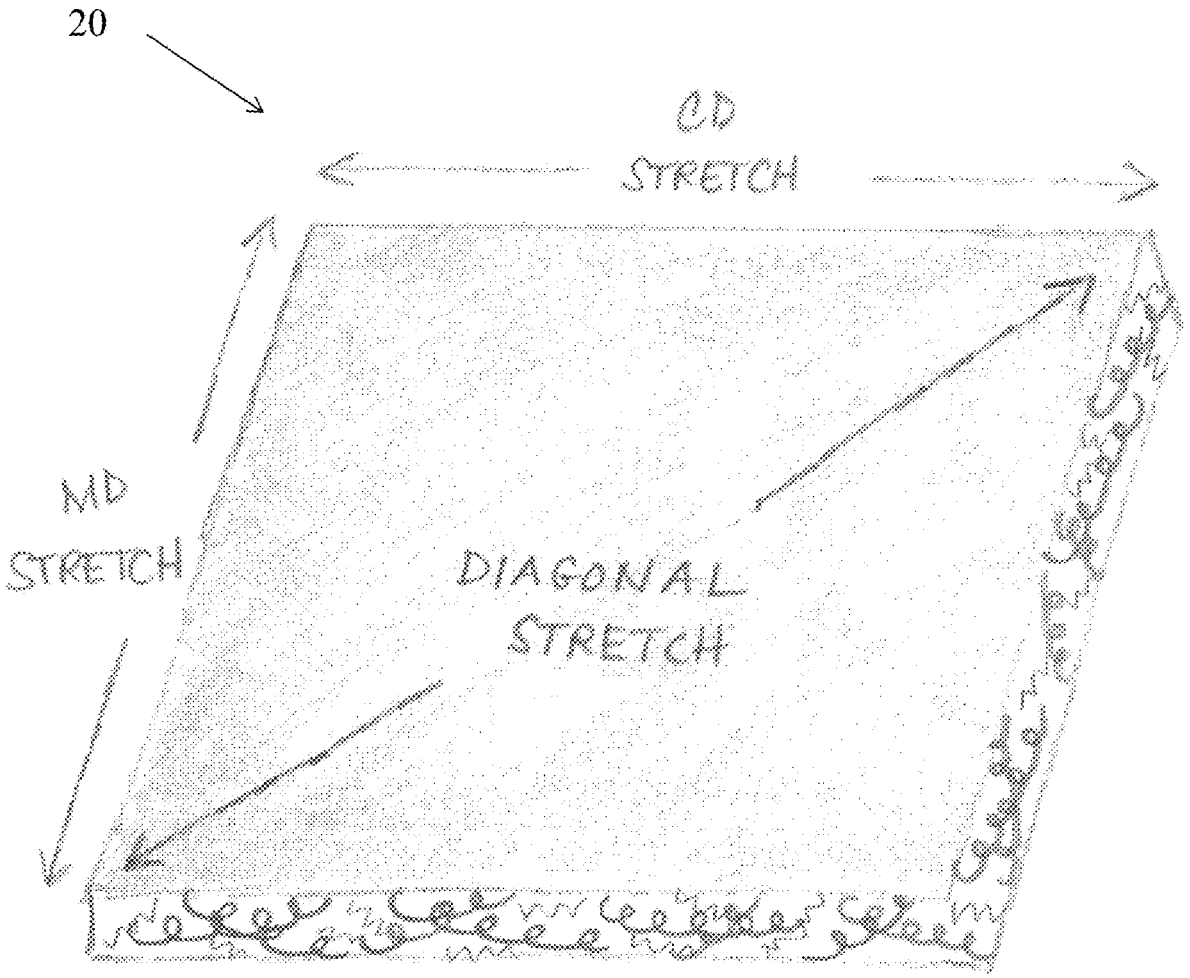
FIG. 2 provides a top-view illustration of machine, cross, and diagonal directions in an embodiment of the inventive batting.
Figure 3A:
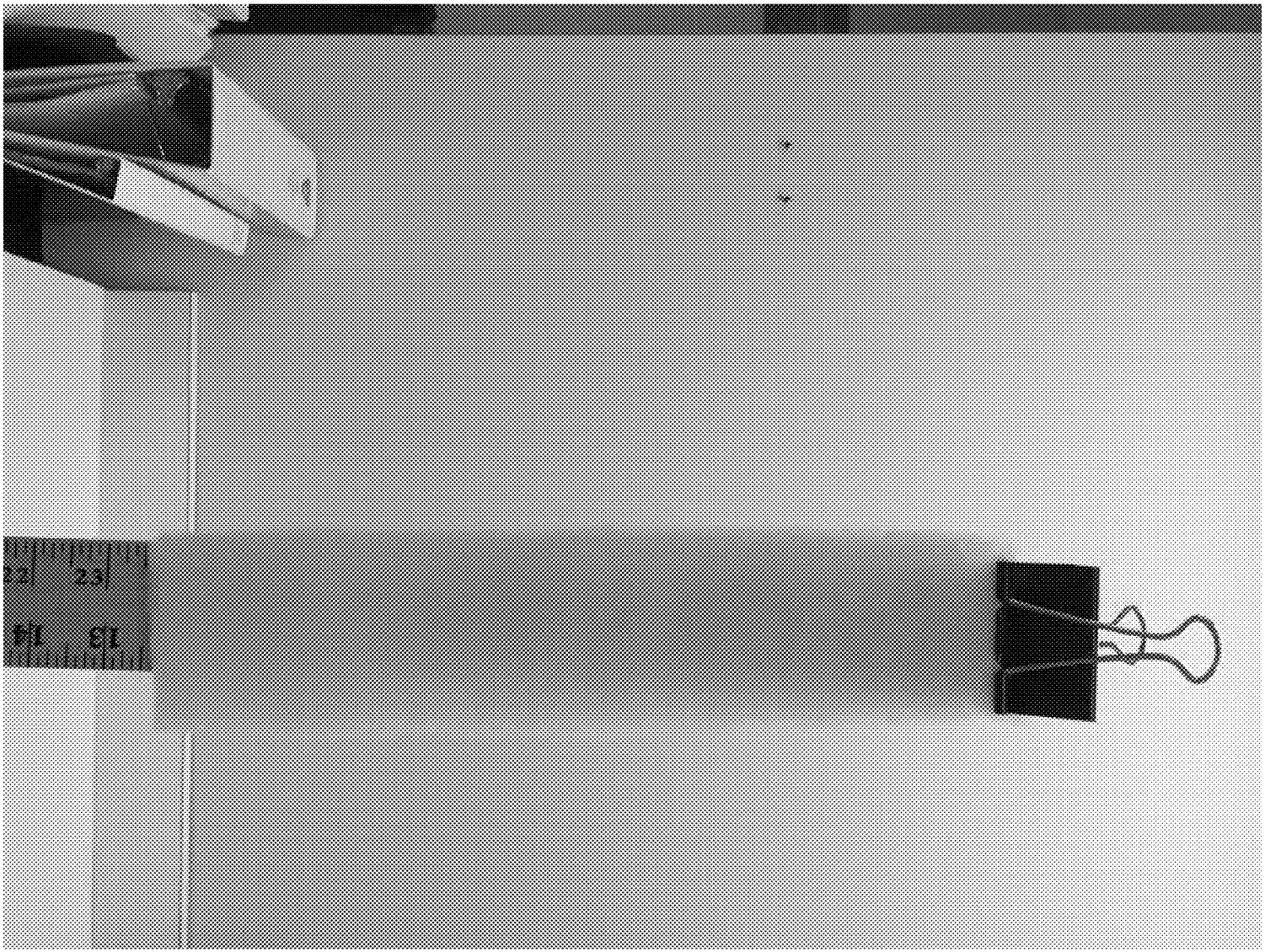
FIGS. 3A and 3B are photographs of an embodiment of the inventive batting.
Figure 3B:
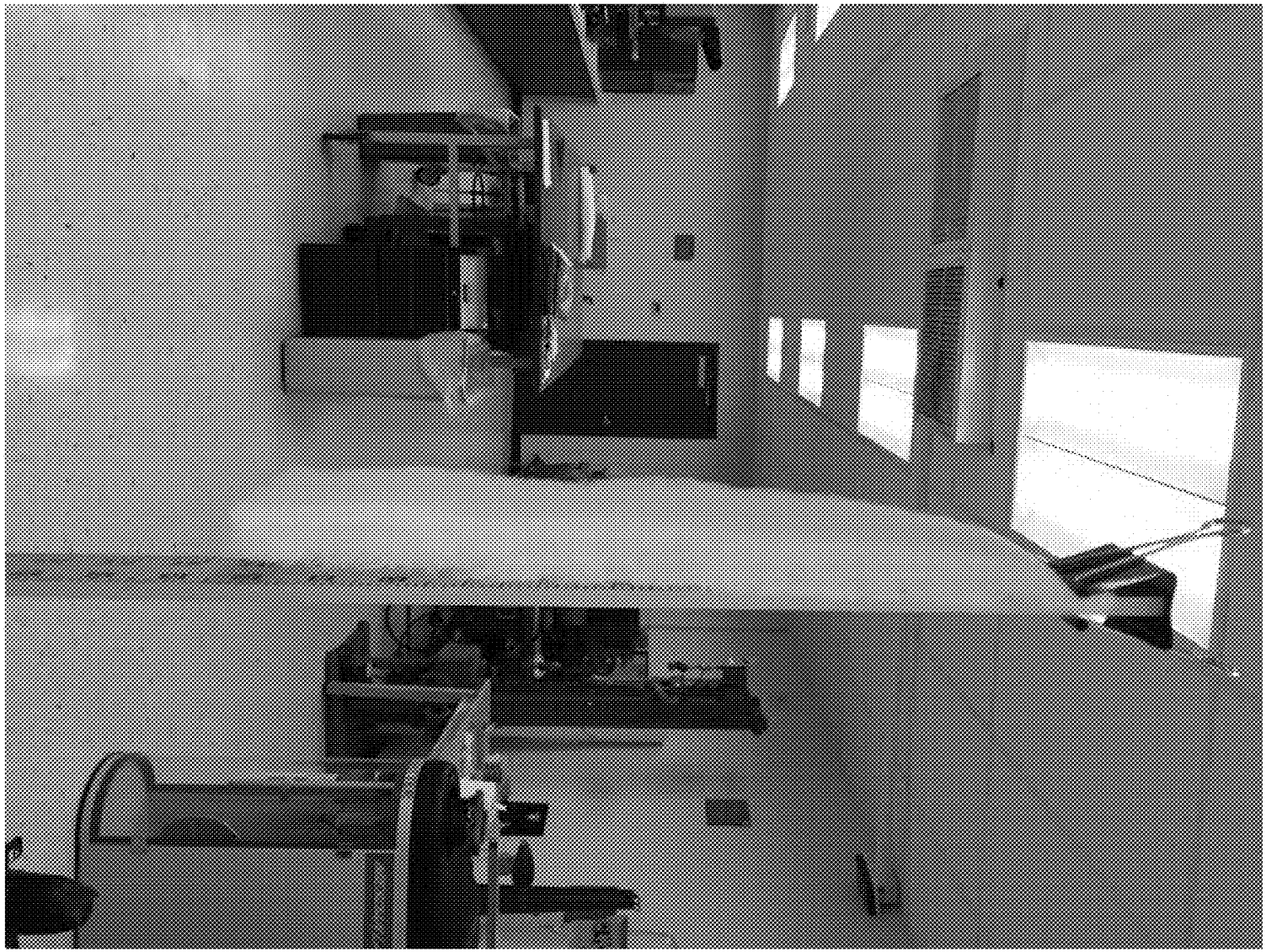
Figure 4A:
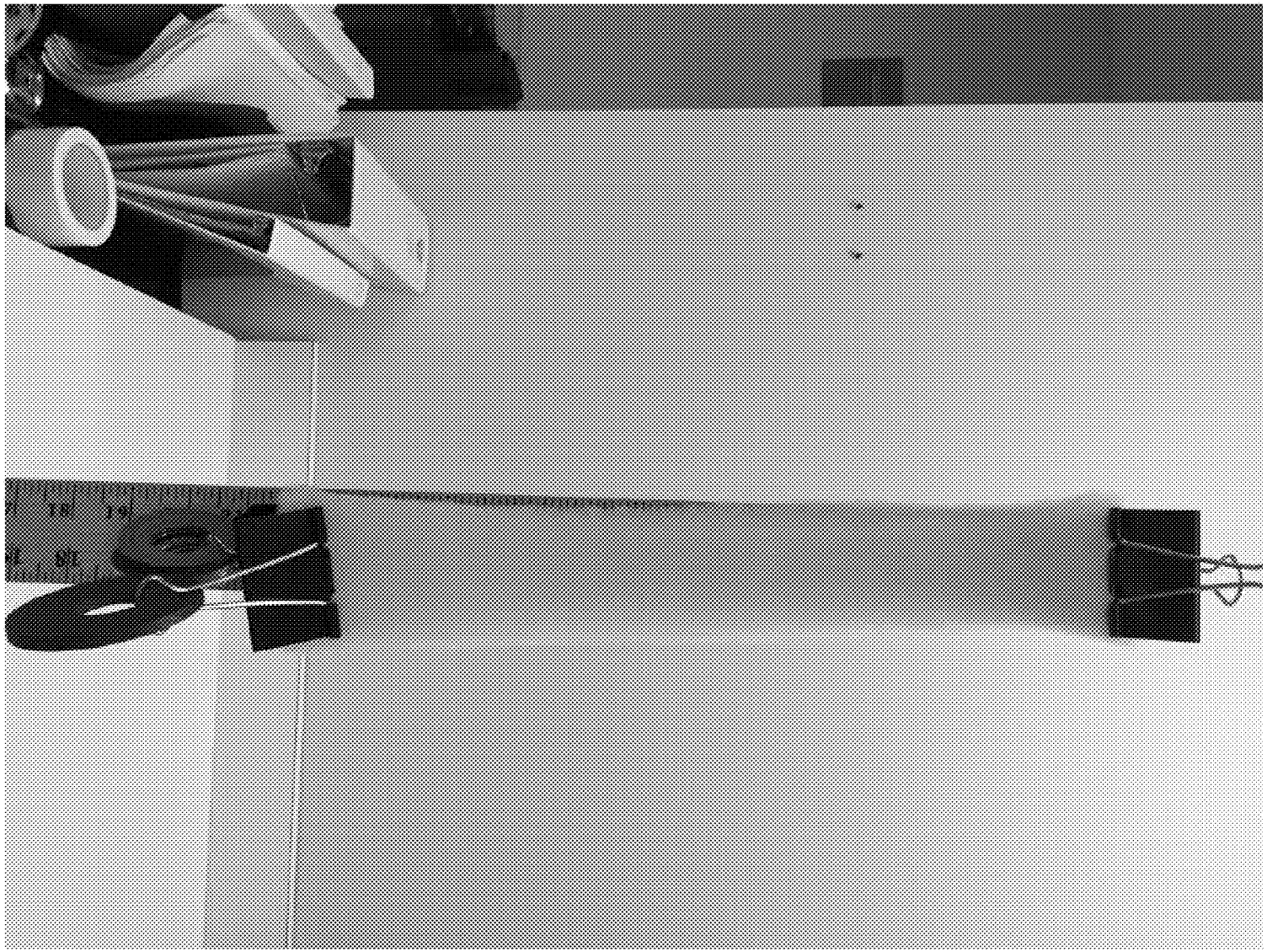
FIGS. 4A and 4B are photographs of an embodiment of the inventive batting stretched under a load of 0.65 lbs.
Figure 4B:
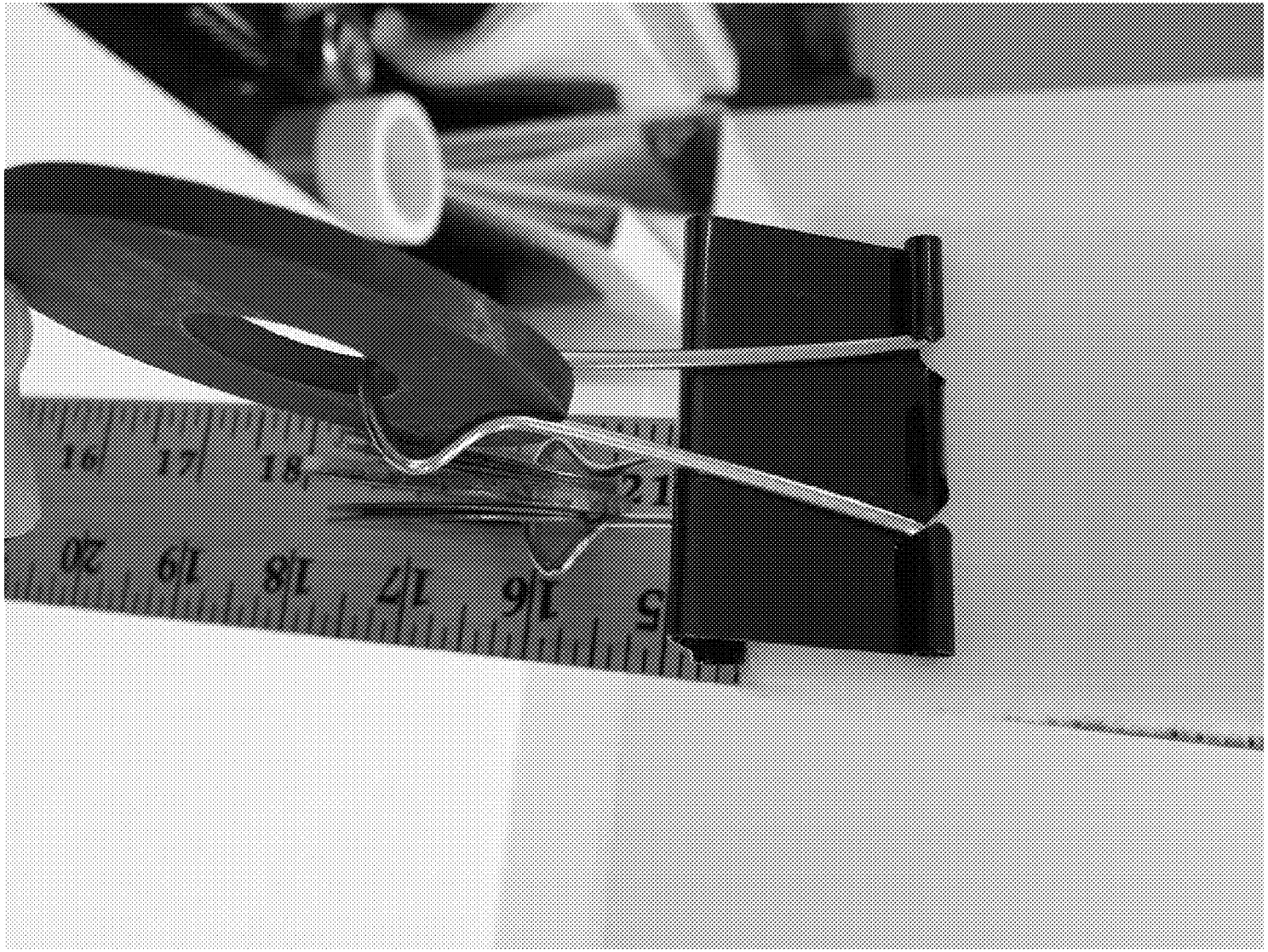

FIG. 2 provides a top-view illustration of machine, cross, and diagonal directions in a portion of an embodiment of the inventive batting 20. FIGS. 3A and 3B are photographs of an embodiment of the inventive batting. FIGS. 4A and 4B are photographs of the embodiment of the inventive batting shown in FIGS. 3A and 3B, stretched in the machine direction under a load of 0.65 lbs. The depicted batting embodiment exhibited MD stretch of 16%.

In some embodiments, the batting has a weight of 60 to 200 gsm (e.g., 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, 100, 101, 102, 103, 104, 105, 106, 107, 108, 109, 110, 111, 112, 113, 114, 115, 116, 117, 118, 119, 120, 121, 122, 123, 124, 125, 126, 127, 128, 129, 130, 131, 132, 133, 134, 135, 136, 137, 138, 139, 140, 141, 142, 143, 144, 145, 146, 147, 148, 149, 150, 151, 152, 153, 154, 155, 156, 157, 158, 159, 160, 161, 162, 163, 164, 165, 166, 167, 168, 169, 170, 171, 172, 173, 174, 175, 176, 177, 178, 179, 180, 181, 182, 183, 184, 185, 186, 187, 188, 189, 190, 191, 192, 193, 194, 195, 196, 197, 198, 199, or 200 gsm), including any and all ranges and subranges therein. For example, in some embodiments, the batting has a weight of 60, 75, 80, 100, 125, 133, 150, 170, 175, or 200 gsm.

In some embodiments, the batting has a migration resistance rating of 4 or 5. Migration resistance, as discussed herein, is measured in accordance with the IDFL (International Down and Feather Testing Laboratory) Downproffness—International Rotation Box standard test method. In accordance with that method, a 45.5 cm plastic box tumbler with a door on one side is used. A motor rotates the box at a speed of 48+/−2 revolutions per minute. Twenty-four No. 6.5 solid silicone stoppers are used in the box. A clean sample article is placed in the box, and the box is rotated for 30 minutes. All fibers and clusters are collected from the surface of the article, tumbler box and silicone stoppers. Collection material is evaluated and counted, and a numerical rating of 1 (significant fiber migration) to 5 (little or no fiber migration) is assigned, as shown in Table I, based on the amount of fibers (only fibers >4 mm are counted) that escape or protrude through the fabric of the article after the 30 minute tumbling period.

TABLE I

| Fiber Migration Ratings | |
|---|---|
| Rating | Fibers (>4 mm) |
| 5 | <5 |
| 4 | 6-10 |
| 3 | 11-20 |
| 2 | 21-30 |
| 1 | >31 |

In a second aspect, the invention provides an article comprising the inventive batting. Non-limiting examples of such articles include, for example, outerwear (e.g. outerwear garments such as jackets, etc.), clothing, sleeping bags, bedding (e.g., comforters), etc. In some embodiments, the article is a piece of active wear (e.g., clothing, including footwear, worn for sport or physical exercise).

In a third aspect, the invention provides a method of making the inventive batting, said method comprising:

preparing a fiber mixture by mixing:

35 to 65 wt % of a first population of synthetic polymeric fibers having a denier of less than or equal to 1.0, wherein 50 to 100 wt % of said synthetic polymeric fibers are siliconized fibers;

10 to 30 wt % of a second population of spiral-crimped synthetic polymeric fibers having a length of greater than or equal to 60 mm, wherein 50 to 100 wt % of said spiral-crimped synthetic polymeric fibers are siliconized fibers;

20 to 50 wt % elastomeric fibers having a denier between 2.0 and 7.0; and 5 to 25 wt % synthetic binder fibers having a denier of 1.5 to 4.0, said binder fibers have a bonding temperature lower than the softening temperature of the synthetic polymeric fibers;

forming a nonwoven web from the fiber mixture, said nonwoven web comprising a first surface parallel to a second surface;

heating the non-woven web to or in excess of the bonding temperature of the binder fibers, thereby forming a bonded nonwoven web;

applying a cross-linker solution comprising a cross-linker compound to the first and second surfaces of the bonded nonwoven web; and heating the bonded nonwoven web to a temperature in excess of the glass transition temperature of the cross-linker compound, thereby forming the batting.

The fiber mixture can be any embodiment as described above in the first aspect of the invention.

In some embodiments, the nonwoven web is formed using a carding machine.

The cross-linker solution is a solution comprising a chemical cross-linker compound. The cross-linker solution is used as a bonding agent on the fibers at the first and second surfaces of the batting. In some embodiments, the cross-linker solution and/or the cross-linker compound display softness and hydrophobicity. In some embodiments, the cross-linker compound has a glass transition temperature (Tg) of less than 0° C. Such cross-linker compounds contribute to the softness and beneficial properties of the inventive batting. On the other hand, most known chemical bonding agents cause the insulation structure to feel brittle and have reduced drape. In some embodiments, the cross-linker compound comprises an acrylate (co)polymer.

In some embodiments, potential coagulation of the cross-linker solution is minimized prior to applying the cross-linker solution to the first and second surfaces of the nonwoven web. In some embodiments, this is achieved by, e.g., a filtration or sieve process.

In some embodiments, the applying the cross-linker solution comprises spraying the solution onto the first and second surfaces of the nonwoven web, and wherein, during spraying, spray drops of the solution have an average median diameter of 150 to 250 μm (e.g., 150, 160, 170, 180, 190, 200, 210, 220, 230, 240, or 250 μm), including any and all ranges and subranges therein.

In some embodiments, during said applying, spray nozzles traverse over the top and across the width of the first and second surfaces of the batting. In some embodiments, the spray nozzles maximize atomization of the cross-linker solution.

In some embodiments, the cross-linker solution, when sprayed on the first and second surfaces, is of uniform distribution and thickness.

In some embodiments, the drop surface area density of the crosslinker solution on the first and second surfaces of the nonwoven web is 5 to 10 g/m$^2$ (e.g., 5, 6, 7, 8, 9, or 10 g/m$^2$), including any and all ranges and subranges therein (e.g., 7 to 8 g/m$^2$).

In some embodiments, said heating the bonded nonwoven web comprises two or more steps, including:

heating in an oven; and heating in a calendaring process.

In some embodiments, heating in a calendaring process utilizes a temperature of 150 to 175° C., including any and all ranges and subranges therein.

In some embodiments, calendaring production line speeds do not exceed 5 meters per minute.

The heating process(es) serve to cure the crosslinker solution, so as to obtain, on each of the first and second surfaces, the cross-linked resin.

Example

The invention will now be illustrated, but not limited, by reference to the specific embodiment described in the following example.

A sample batting is made according to the above method. The fiber mix for the sample is 10% 2.0 denier 51 mm ELK type low-melt polyester binder fiber; 45% 0.7 denier 51 mm siliconized polyester fiber with standard planar crimp; 25% 6.0 denier 64 mm E-Plex elastomeric fiber; and 20% 7.0 denier 64 mm siliconized polyester fiber with spiral crimp. The fiber mix is processed through a carding machine to obtain a non-woven web batting precursor, which is heated at 110° C. Migration resistant surfaces comprising a cross-linked resin are formed by using a cross-linker solution comprising a hydrophobic self-crosslinking chemical (an aqueous copolymer acrylate dispersion) having a glass transition temperature (Tg) of less than 0° C. Coagulation of the solution is minimized prior to treatment by using a filtration or sieve process. The solution was sprayed on the surfaces using spray nozzles that traverse over the top and across the complete width of the precursor batting, applying the solution. The volume median diameter of the spray drops range between 150 to 250 micrometers, and the drop surface area density is controlled between the range of 7 to 8 grams per square meter on each surface. After applying the cross-linker solution to both the first and second surfaces, the batting is heat cured using a three pass oven system. Following the application of the chemical and the heat curing process, the insulation structure passes over a heated roll calendaring system at 150 to 175° C., which completes the sealing/cross-linking of the cross-linker compound in the cross-linker solution. The insulative batting is allowed to cool, then proceeds to windup and packaging, then to incorporation into an article.

The example batting has a weight of 100 gsm (grams per square meter), a thickness of 15 mm, and a density of 6.7 kg/m$^3$, and exhibits the following performance features:

Thermals—0.79 clo/oz/sqyd

Water Adsorption—27%

MD Stretch—16%

CD Stretch—16%

Diagonal Stretch—15%

Migration Resistance—Rating 5 Excellent

As indicated, the invention provides superior insulative batting that is fiber migration resistant, and that offers, by virtue of its inventive components, highly advantageous stretchability.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include" (and any form of include, such as "includes" and "including"), "contain" (and any form contain, such as "contains" and "containing"), and any other grammatical variant thereof, are open-ended linking verbs. As a result, a method or article that "comprises", "has", "includes" or "contains" one or more steps or elements possesses those one or more steps or elements, but is not limited to possessing only those one or more steps or elements. Likewise, a step of a method or an element of an article that "comprises", "has", "includes" or "contains" one or more features possesses those one or more features, but is not limited to possessing only those one or more features.

As used herein, the terms "comprising," "has," "including," "containing," and other grammatical variants thereof encompass the terms "consisting of" and "consisting essentially of."

The phrase "consisting essentially of" or grammatical variants thereof when used herein are to be taken as specifying the stated features, integers, steps or components but do not preclude the addition of one or more additional features, integers, steps, components or groups thereof but only if the additional features, integers, steps, components or groups thereof do not materially alter the basic and novel characteristics of the claimed compositions or methods.

All publications cited in this specification are herein incorporated by reference as if each individual publication were specifically and individually indicated to be incorporated by reference herein as though fully set forth.

Subject matter incorporated by reference is not considered to be an alternative to any claim limitations, unless otherwise explicitly indicated.

Where one or more ranges are referred to throughout this specification, each range is intended to be a shorthand format for presenting information, where the range is understood to encompass each discrete point within the range as if the same were fully set forth herein.

While several aspects and embodiments of the present invention have been described and depicted herein, alternative aspects and embodiments may be affected by those skilled in the art to accomplish the same objectives. Accordingly, this disclosure and the appended claims are intended to cover all such further and alternative aspects and embodiments as fall within the true spirit and scope of the invention.

The invention claimed is:

1. Batting comprising a bonded nonwoven web having a first surface parallel to a second surface, wherein said bonded nonwoven web comprises a fiber mixture having:

35 to 65 wt % of a first population of synthetic polymeric fibers having a denier between 0.7 and 1.0, wherein 50 to 100 wt % of said synthetic polymeric fibers are siliconized fibers, and wherein the first population of synthetic polymeric fibers have a length of 18 mm to 59 mm;

10 to 30 wt % of a second population of spiral-crimped synthetic polymeric fibers having a length of greater than or equal to 60 mm, wherein 50 to 100 wt % of said spiral-crimped synthetic polymeric fibers are siliconized fibers;

20 to 50 wt % elastomeric fibers having a denier between 2.0 and 7.0, wherein the elastomeric fibers have a length of 55 to 80 mm; and 12 to 25 wt % synthetic binder fibers having a denier of 1.5 to 4.0, said binder fibers have a bonding temperature lower than the softening temperature of the first population of synthetic polymeric fibers and the second population of spiral-crimped synthetic polymeric fibers, the bonding temperature being between 80° C. and 150°, wherein fibers in the fiber mixture are homogenously mixed such that the fiber mixture has a 90-100% uniform composition, and wherein said first and second surfaces comprise a cross-linked resin.

2. The batting according to claim 1, wherein the first population of synthetic polymeric fibers have a length of 18 mm to 51 mm.

3. The batting according to claim 1, wherein the second population of spiral-crimped synthetic polymeric fibers have a length of 60 to 75 mm.

4. The batting according to claim 1, wherein the elastomeric fibers have a length of 58 to 71 mm.

5. The batting according to claim 1, wherein the synthetic binder fibers have a length of 20 mm to 71 mm.

6. The batting according to claim 1, wherein the first population of synthetic polymeric fibers have a non-spiral crimp.

7. The batting according to claim 1, wherein the fiber mixture comprises:

40 to 55 wt % of the first population of synthetic polymeric fibers, said fibers having a non-spiral crimp;

15 to 25 wt % of the second population of spiral-crimped synthetic polymeric fibers;

20 to 35 wt % of the elastomeric fibers; and 12 to 15 wt % of the synthetic binder fibers.

8. The batting according to claim 1, wherein 75 to 100 wt % of the first population of synthetic polymeric fibers are siliconized fibers.

9. The batting according to claim 1, wherein 75 to 100 wt % of the second population of spiral-crimped synthetic polymeric fibers are siliconized fibers.

10. The batting according to claim 1, wherein the first population of synthetic polymeric fibers and the second population of spiral-crimped synthetic polymeric fibers are polyester fibers.

11. The batting according to claim 1, wherein the cross-linked resin comprises a cross-linked acrylate (co)polymer.

12. The batting according to claim 1, having a density of 5.0 to 7.5 kg/m$^3$.

13. The batting according to claim 1, having a thermal performance rating of at least 0.75 clo/oz/yd$^2$ when tested according to ISO 11092.

14. The batting according to claim 1, having a water uptake of less than or equal to 30 wt %.

15. The batting according to claim 1, having multidirectional stretch of 10-20% in machine, cross, and diagonal directions, under a load of 0.65 lbs, when tested according to ASTM D3107.

16. The batting according to claim 1, having a migration resistance rating of 5.

17. An article comprising the batting according to claim 1.

18. The article according to claim 17, wherein said article is selected from the group consisting of an outerwear product, clothing, a sleeping bag, and bedding.

19. The batting according to claim 1, wherein the fiber mixture comprises 25 wt % to 50 wt % elastomeric fibers.

20. A method of making the batting according to claim 1, said method comprising:

preparing a fiber mixture by mixing:

35 to 65 wt % of a first population of synthetic polymeric fibers having a denier between 0.7 and 1.0, wherein 50 to 100 wt % of said synthetic polymeric fibers are siliconized fibers, and wherein the first population of synthetic polymeric fibers have a length of 18 mm to 59 mm;

10 to 30 wt % of a second population of spiral-crimped synthetic polymeric fibers having a length of greater than or equal to 60 mm, wherein 50 to 100 wt % of said spiral-crimped synthetic polymeric fibers are siliconized fibers;

20 to 50 wt % elastomeric fibers having a denier between 2.0 and 7.0, wherein the elastomeric fibers have a length of 55 to 80 mm; and 12 to 25 wt % synthetic binder fibers having a denier of 1.5 to 4.0, said binder fibers have a bonding temperature lower than the softening temperature of the first population of synthetic polymeric fibers and the second population of spiral-crimped synthetic polymeric fibers, the bonding temperature being between 80° C. and 150°, wherein fibers in the fiber mixture are homogenously mixed such that the fiber mixture has a 90-100% uniform composition;

forming a nonwoven web from the fiber mixture, said nonwoven web comprising a first surface parallel to a second surface;

heating the non-woven web to or in excess of the bonding temperature of the binder fibers, thereby forming a bonded nonwoven web;

applying a cross-linker solution comprising a cross-linker compound to the first and second surfaces of the bonded nonwoven web; and heating the bonded nonwoven web to a temperature in excess of the glass transition temperature of the cross-linker compound, thereby forming the batting.

21. The method according to claim 20, wherein the cross-linker compound has a glass transition temperature (Tg) of less than 0° C.

22. The method according to claim 20, wherein the cross-linker compound comprises an acrylate (co)polymer.

23. The method according to claim 20, wherein coagulation of the cross-linker solution is minimized prior to applying the cross-linker solution to the first and second surfaces of the nonwoven web.

24. The method according to claim 20, wherein the applying the cross-linker solution comprises spraying the solution onto the first and second surfaces of the nonwoven web, and wherein, during spraying, spray drops of the solution have an average median diameter of 150 to 250 μm.

25. The method according to claim 24, wherein drop surface area density of the crosslinker solution on the first and second surfaces of the nonwoven web is 7 to 8 g/m$^2$.

26. The method according to claim 20, wherein said heating the bonded nonwoven web comprises two or more steps, including:

heating in an oven; and heating in a calendaring process.

27. The method according to claim 26, wherein said heating in a calendaring process utilizes a temperature of 150 to 175° C., and wherein calendaring production line speeds to not exceed 5 meters per minute.

28. The method according to claim 20, wherein the fiber mixture comprises 25 wt % to 50 wt % elastomeric fibers.

* * * * *